US008230978B2

(12) United States Patent
Agirman et al.

(10) Patent No.: US 8,230,978 B2
(45) Date of Patent: Jul. 31, 2012

(54) ELEVATOR REGENERATIVE DRIVE WITH AUTOMATIC RESCUE OPERATION

(75) Inventors: Ismail Agirman, Farmington, CT (US); Vladimir Blasko, Avon, CT (US); Frank Higgins, Burlington, CT (US)

(73) Assignee: Otis Elevator Company, Farmington, CT (US)

( * ) Notice: Subject to any disclaimer, the term of this patent is extended or adjusted under 35 U.S.C. 154(b) by 471 days.

(21) Appl. No.: 12/526,872

(22) PCT Filed: Feb. 13, 2007

(86) PCT No.: PCT/US2007/004000
§ 371 (c)(1),
(2), (4) Date: Aug. 12, 2009

(87) PCT Pub. No.: WO2008/100259
PCT Pub. Date: Aug. 21, 2008

(65) Prior Publication Data

US 2010/0044160 A1 Feb. 25, 2010

(51) Int. Cl.
*B66B 1/06* (2006.01)

(52) U.S. Cl. ..... 187/290; 187/296

(58) Field of Classification Search ..... 187/290, 187/293, 296, 297, 391–393; 318/375, 376, 318/798–815
See application file for complete search history.

(56) References Cited

U.S. PATENT DOCUMENTS

| | | | | | |
|---|---|---|---|---|---|
| 4,484,664 | A * | 11/1984 | Nomura | 187/290 |
| 4,548,299 | A * | 10/1985 | Nomura | 187/290 |
| 5,285,029 | A * | 2/1994 | Araki | 187/290 |
| 5,896,948 | A * | 4/1999 | Suur-Askola et al. | 187/290 |
| 5,945,644 | A * | 8/1999 | Jang | 187/296 |
| 6,315,081 | B1 | 11/2001 | Yeo | |
| 6,431,324 | B2 * | 8/2002 | Tajima et al. | 187/290 |
| 6,435,312 | B2 | 8/2002 | Tajima et al. | |
| 6,435,313 | B2 * | 8/2002 | Tajima et al. | 187/290 |
| 6,471,013 | B2 | 10/2002 | Banno et al. | |
| 6,533,074 | B2 * | 3/2003 | Tominaga et al. | 187/290 |
| 6,732,838 | B1 * | 5/2004 | Okada et al. | 187/290 |
| 6,827,182 | B2 * | 12/2004 | Araki | 187/290 |
| 7,275,622 | B2 * | 10/2007 | Hall et al. | 187/290 |
| 7,540,355 | B2 * | 6/2009 | Harkonen | 187/290 |
| 7,775,328 | B2 * | 8/2010 | Robledo Barrio et al. | 187/290 |
| 8,083,033 | B2 * | 12/2011 | Kallioniemi et al. | 187/290 |

OTHER PUBLICATIONS

PCT International Search Report and Written Opinion, Jan. 4, 2008, 5 pages.

* cited by examiner

*Primary Examiner* — Anthony Salata
(74) *Attorney, Agent, or Firm* — Kinney & Lange, P.A.

(57) ABSTRACT

A system (10) continuously drives an elevator hoist motor (14) during normal and power failure operating conditions. A regenerative drive (30, 34, 36) delivers power to the hoist motor (14) from a main power supply (17) during the normal operating condition and from a backup power supply (24) during the power failure operating condition. A controller (12) operates the regenerative drive (30, 34, 36) to provide available power on the regenerative drive (30, 34, 36) to the backup power supply (24) during the normal operating condition.

23 Claims, 3 Drawing Sheets

ELEVATOR REGENERATIVE DRIVE WITH AUTOMATIC RESCUE OPERATION

BACKGROUND OF THE INVENTION

The present invention relates to the field of power systems. In particular, the present invention relates to an elevator power system including a regenerative drive operable to provide automatic rescue operation and to charge the backup power source associated with the automatic rescue operation.

An elevator drive system is typically designed to operate over a specific input voltage range from a power source. The components of the drive have voltage and current ratings that allow the drive to continuously operate while the power supply remains within the designed input voltage range. However, in certain markets the utility network is less reliable, and utility voltage sags, brownout conditions (i.e., voltage conditions below the tolerance band of the drive) and/or power loss conditions are prevalent. When utility voltage sags occur, the drive draws more current from the power supply to maintain uniform power to the hoist motor. In conventional systems, when excess current is being drawn from the power supply, the drive will shut down to avoid damaging the components of the drive.

When a power sag or power loss occurs, the elevator may become stalled between floors in the elevator hoistway until the power supply returns to the nominal operating voltage range. In conventional systems, passengers in the elevator may be trapped until a maintenance worker is able to release a brake for controlling cab movement upwardly or downwardly to allow the elevator to move to the closest floor. More recently, elevator systems employing automatic rescue operation have been introduced. These elevator systems include electrical energy storage devices that are controlled after power failure to provide power to move the elevator to the next floor for passenger disembarkation. However, many current automatic rescue operation systems are complex and expensive to implement, and may provide unreliable power to the elevator drive after a power failure. In addition, current systems require a dedicated charger for the backup power source associated with the automatic rescue operation procedure.

BRIEF SUMMARY OF THE INVENTION

The subject invention is directed to a system for continuously driving an elevator hoist motor during normal and power failure operating conditions. A regenerative drive delivers power to the hoist motor from a main power supply during the normal operating condition and from a backup power supply during the power failure operating condition. A controller operates the regenerative drive to provide available power on the regenerative drive to the backup power supply during the normal operating condition.

DETAILED DESCRIPTION

Figure 1:
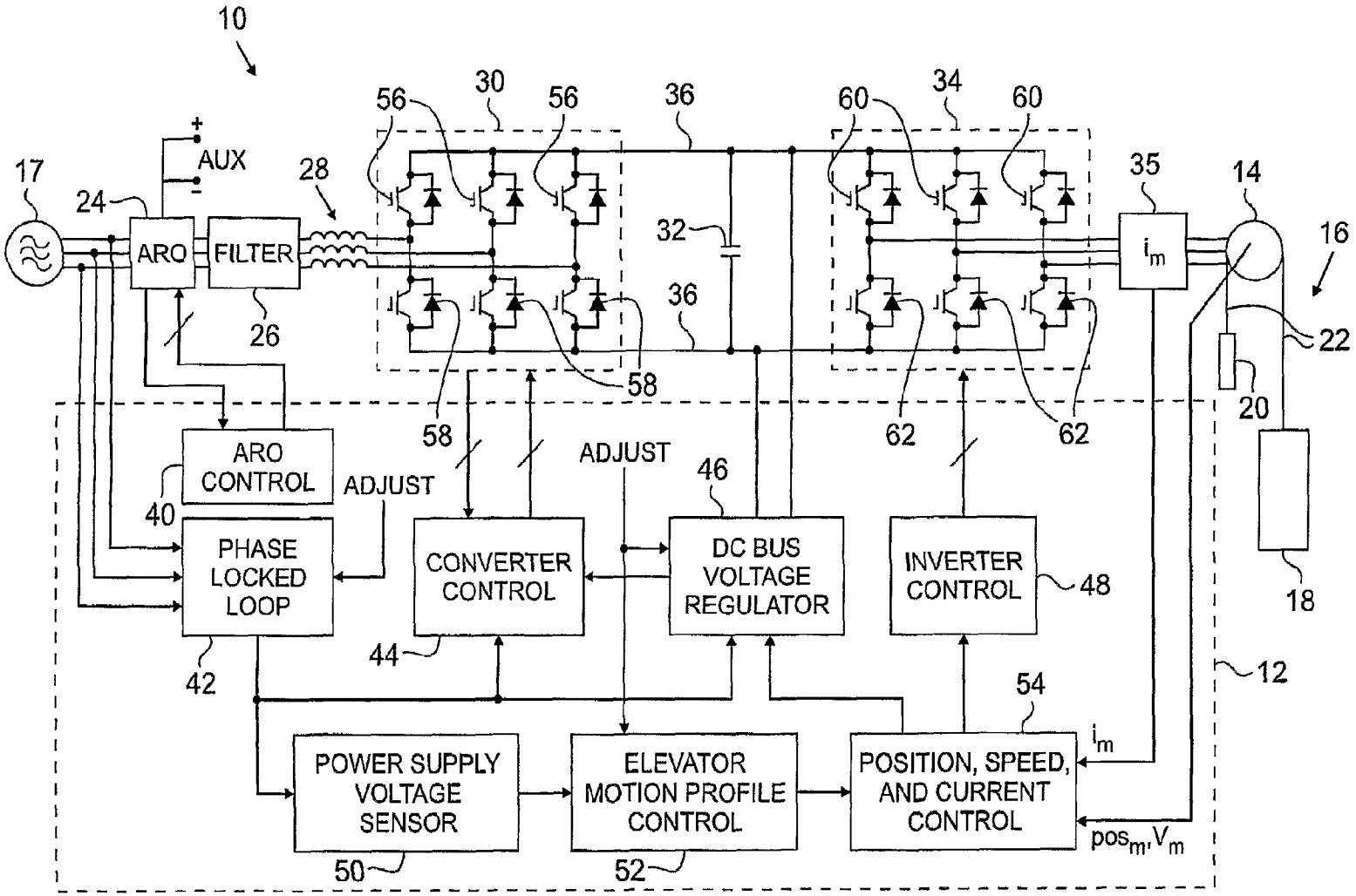
FIG. 1 is a schematic view of a power system including a controller and a regenerative drive for continuously driving an elevator hoist during normal and power failure operating conditions.

FIG. 1 is a schematic view of a power system 10 including a controller 12 for driving hoist motor 14 of elevator 16 from main power supply 17 according to an embodiment of the present invention. Elevator 16 includes elevator cab 18 and counterweight 20 that are connected through roping 22 to hoist motor 14. Main power supply 17 may be electricity supplied from an electrical utility, such as from a commercial power source.

As will be described herein, power system 10 is configured to provide substantially uninterrupted power during normal and power failure conditions to drive hoist motor 14 and other elevator systems. In certain markets the utility network is less reliable, where persistent utility voltage sags, brownout conditions, and/or power loss conditions are prevalent. Power system 10 according to the present invention includes automatic rescue operation (ARO) circuit 24 to allow for continuous operation of hoist motor 14 at normal operating conditions during these periods of irregularity by switching from the failing main power supply to a backup power supply. In addition, power system 10 is operable to provide available power to recharge the backup power supply during normal and power saving operating conditions. While the following description is directed to driving an elevator hoist motor, it will be appreciated that ARO circuit 24 may be employed to provide continuous power to any type of load.

Power system 10 includes controller 12, automatic rescue operation (ARO) circuit 24, electromagnetic interference (EMI) filter 26, line reactors 28, power converter 30, smoothing capacitor 32, power inverter 34, and motor current sensor 35. Power converter 30 and power inverter 34 are connected by power bus 36. Smoothing capacitor 32 is connected across power bus 36. Controller 12 includes ARO control 40, phase locked loop 42, converter control 44, DC bus voltage regulator 46, inverter control 48, power supply voltage sensor 50, elevator motion profile control 52, and position, speed, and current control 54. In one embodiment, controller 12 is a digital signal processor (DSP), and each of the components of controller 12 are functional blocks that are implemented in software executed by controller 12.

ARO control 40 is connected between main power supply 17 and EMI filter 26, and provides control signals ARO circuit 24 as its output. Line reactors 28 are connected between EMI filter 26 and power converter 30. Phase locked loop 42 receives the three-phase signal from main power supply 17 as an input, and provides an output to converter control 44, DC bus voltage regulator 46, and power supply voltage sensor 50. Converter control 44 also receives an input from DC bus voltage regulator and provides an output to power converter 30. Power supply voltage sensor 50 provides an output to elevator motion profile control 52, which in turn provides an output to position, speed, and current control 54. DC bus voltage regulator 46 receives signals from phase locked loop 42 and position, speed, and current control 54, and monitors the voltage across power bus 36. Inverter control 48 also receives a signal from position, speed, and current control 54 and provides a control output to power inverter 34.

Main power supply 17, which may be a three-phase AC power supply from the commercial power source, provides electrical power to power converter 30 during normal operating conditions (e.g., within 10% of normal operating voltage of main power supply 17). As will be described with regard to FIG. 2, during power failure conditions, ARO circuit 24 is controlled to switch to from main power supply 17 to a backup power supply. Power converter 30 is a three-phase power converter that is operable to convert three-phase AC power from main power supply 17 to DC power. In one embodiment, power converter 30 comprises a plurality of power transistor circuits including parallel-connected transistors 56 and diodes 58. Each transistor 56 may be, for example, an insulated gate bipolar transistor (IGBT). The controlled electrode (i.e., gate or base) of each transistor 56 is connected to converter control 44. Converter control 44 controls the power transistor circuits to rectify the three-phase AC power from main power supply 17 to DC output power. The DC output power is provided by power converter 30 on power bus 36. Smoothing capacitor 32 smoothes the rectified power provided by power converter 30 on power bus 36. It should be noted that while main power supply 17 is shown as a three-phase AC power supply, power system 10 may be adapted to receive power from any type of power source, including a single phase AC power source and a DC power source.

The power transistor circuits of power converter 30 also allow power on power bus 36 to be inverted and provided to main power supply 17. In one embodiment, controller 12 employs pulse width modulation (PWM) to produce gating pulses so as to periodically switch the transistors 56 of power converter 30 to provide a three-phase AC power signal to main power supply 17. This regenerative configuration reduces the demand on main power supply 17. EMI filter 26 is connected between main power supply 17 and power converter 30 to suppress voltage transients, and line reactors 28 are connected between main power supply 17 and power converter 30 to control the current passing between main power supply 17 and power converter 30. In another embodiment, power converter 30 comprises a three-phase diode bridge rectifier.

Power inverter 34 is a three-phase power inverter that is operable to invert DC power from power bus 36 to three-phase AC power. Power inverter 34 comprises a plurality of power transistor circuits including parallel-connected transistors 60 and diodes 62. Each transistor 60 may be, for example, an insulated gate bipolar transistor (IGBT). In one embodiment, the controlled electrode (i.e., gate or base) of each transistor 60 is controlled by inverter control 48 to invert the DC power on power bus 36 to three-phase AC output power. The three-phase AC power at the outputs of power inverter 34 is provided to hoist motor 14. In one embodiment, inverter control 48 employs PWM to produce gating pulses to periodically switch transistors 60 of power inverter 34 to provide a three-phase AC power signal to hoist motor 14. Inverter control 48 may vary the speed and direction of movement of elevator 16 by adjusting the frequency and magnitude of the gating pulses to transistors 60.

In addition, the power transistor circuits of power inverter 34 are operable to rectify power that is generated when elevator 16 drives hoist motor 14. For example, if hoist motor 14 is generating power, inverter control 34 deactivates transistors 60 in power inverter 34 to allow the generated power to be rectified by diodes 62 and provided to power bus 36. Smoothing capacitor 32 smoothes the rectified power provided by power inverter 34 on power bus 36.

Hoist motor 14 controls the speed and direction of movement between elevator cab 18 and counterweight 20. The power required to drive hoist motor 14 varies with the acceleration and direction of elevator 16, as well as the load in elevator cab 18. For example, if elevator 16 is being accelerated, run up with a load greater than the weight of counterweight 20 (i.e., heavy load), or run down with a load less than the weight of counterweight 20 (i.e., light load), a maximal amount of power is required to drive hoist motor 14. If elevator 16 is leveling or running at a fixed speed with a balanced load, it may be using a lesser amount of power. If elevator 16 is being decelerated, running down with a heavy load, or running up with a light load, elevator 16 drives hoist motor 14. In this case, hoist motor 14 generates three-phase AC power that is converted to DC power by power inverter 34 under the control of inverter control 30. The converted DC power is accumulated on power bus 36.

Elevator motion profile control 52 generates a signal that is used to control the motion of elevator 16. In particular, automatic elevator operation involves the control of the velocity of elevator 16 during an elevator trip. The time change in velocity for a complete trip is termed the "motion profile" of elevator 16. Thus, elevator motion profile control 52 generates an elevator motion profile that sets the maximum acceleration, the maximum steady state speed, and the maximum deceleration of elevator 16. The particular motion profile and motion parameters generated by elevator motion profile control 52 represent a compromise between the desire for "maximum" speed and the need to maintain acceptable levels of comfort for the passengers.

The motion profile output of elevator motion profile control 52 is provided to position, speed, and current control 54. These signals are compared with actual feedback values of the motor position ($pos_m$), motor speed ($v_m$), and motor current ($i_m$) by position, speed, and current control 54 to determine an error signal related to the difference between the actual operating parameters of hoist motor 14 and the target operating parameters. For example, position, speed, and current control 54 may include proportional and integral amplifiers to provide determine this error signal from the actual and desired adjusted motion parameters. The error signal is provided by position, speed, and current control 54 to inverter control 48 and DC bus voltage regulator 46.

Based on the error signal from position, speed, and current control 54, inverter control 48 calculates signals to be provided to power inverter 34 to drive hoist motor 14 pursuant to the motion profile when hoist motor 14 is motoring. As described above, inverter control 48 may employ PWM to produce gating pulses to periodically switch transistors 60 of power inverter 34 to provide a three-phase AC power signal to hoist motor 14. Inverter control 48 may vary the speed and direction of movement of elevator 16 by adjusting the frequency and magnitude of the gating pulses to transistors 60.

It should be noted that while a single hoist motor 14 is shown connected to power system 10, power system 10 may be modified to power multiple hoist motors 14. For example, a plurality of power inverters 34 may be connected in parallel across power bus 36 to provide power to a plurality of hoist motors 14. As another example, a plurality of drive systems (including line reactors 28, power converter 30, smoothing capacitor 32, power inverter 34, and power bus 36) may be connected in parallel such that each drive system provides power to a hoist motor 12.

Figure 2:
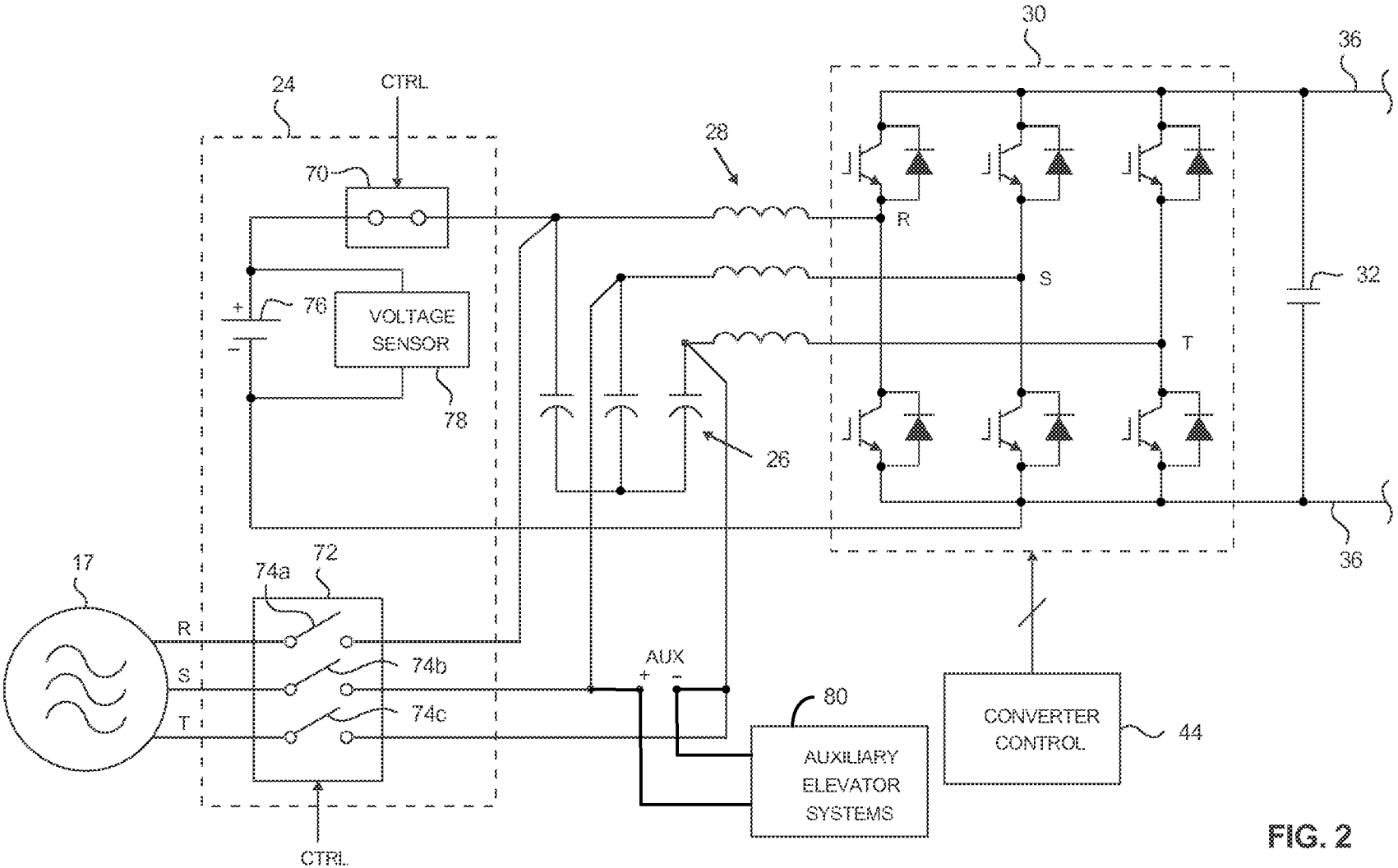
FIG. 2 is a schematic view of an automatic rescue operation circuit for switching from a main power supply to a backup power supply in the event of a power failure.

FIG. 2 is a schematic view of the front end of power system 10 shown in FIG. 1 that is operable to provide continuous operation of hoist motor 14 during normal and power failure operating conditions of main power supply 17. The front end of power system 10 includes main power supply 16, ARO circuit 24, EMI filter 26 (the capacitor portion of EMI filter 26 is shown), line reactors 28, power converter 30, smoothing capacitor 32, power bus 36, and converter control 44.

ARO circuit 24 includes backup power supply switch 70, main power switch module 72 including main power switches 74*a*, 74*b*, and 74*c*, battery 76, and voltage sensor 78. Main power relay switch 74*a* is connected between input R of main power supply 16 and leg R of power converter 30, main power relay switch 74*b* is connected between input S of main power supply 16 and leg S of power converter 30, and main power relay switch 74*a* is connected between input T of main power supply 16 and leg T of power converter 30. Backup power switch 70 is connected between the positive pole of battery 76 and leg R of power converter 30. The negative pole of battery 76 is connected to the common node of power converter 30 and power bus 36. Voltage sensor 78 is connected across battery 76 to measure the voltage of battery 76 and provide signals related to this measurement to ARO control 40 (FIG. 1). It should also be noted that while a single battery 76 is shown, ARO circuit 24 may include any type or configuration of backup power supply, including a plurality of batteries connected in series or supercapacitors.

During normal operating conditions, controller 12 provides signals on ARO control line CTRL to close main power switches 74*a*, 74*b*, and 74*c* and open backup power switch 70 to provide power from main power supply 16 to each of the three phases R, S, and T on power converter 30. If the voltage of main power supply 16 as measured by power supply voltage sensor 50 (FIG. 1) drops below the normal operating range of power system 10, controller 12 provides a signal to ARO circuit 24 via line CTRL that simultaneously opens main power switches 74*a*-74*c* and closes backup power switch 70. This configuration, shown in FIG. 2, connects the positive pole of battery 76 to leg R of power converter 30, and converter control 44 operates the transistors associated with leg R to provide power from battery 76 to power bus 36. Leg R of power converter 30 acts as a bidirectional boost converter to provide stepped-up DC power from battery 76 to power bus 36. The configuration shown is capable of providing DC power from battery 76 on power bus 36 that is as much as 1.5 to two times the voltage of battery 76. Controller 12 operates power inverter 34 based on a motion profile specific for power failure conditions (i.e., at lower speeds) to conserve available power from battery 76. In this way, power system 10 can operate substantially uninterrupted to provide rescue operation to deliver passengers on elevator 16 to the next closest floor after power failure.

Power system 10 may also provide power to other electrical systems, such as auxiliary systems 80 (e.g., machine fans, lighting and outlets of elevator car 18, safety chains, and the system transformer) during power failure by operating legs S and T of power converter 30 to invert DC power on power bus 36 to AC power. The AC power is provided to the auxiliary systems 80 via the AUX connection. Converter control 44 may apply PWM signals to the transistors associated with legs S and T to invert the DC power on power bus 36. In one embodiment, the PWM signals are bipolar sinusoidal voltage commands. The inverted voltage on the AUX connection is filtered for current and voltage transients by line reactors 28 and EMI filter 26. A fault management device, such as a current regulator, may also be implemented between the S leg and the AUX connection to prevent shorts or overloading at the AUX connection.

Figure 3:
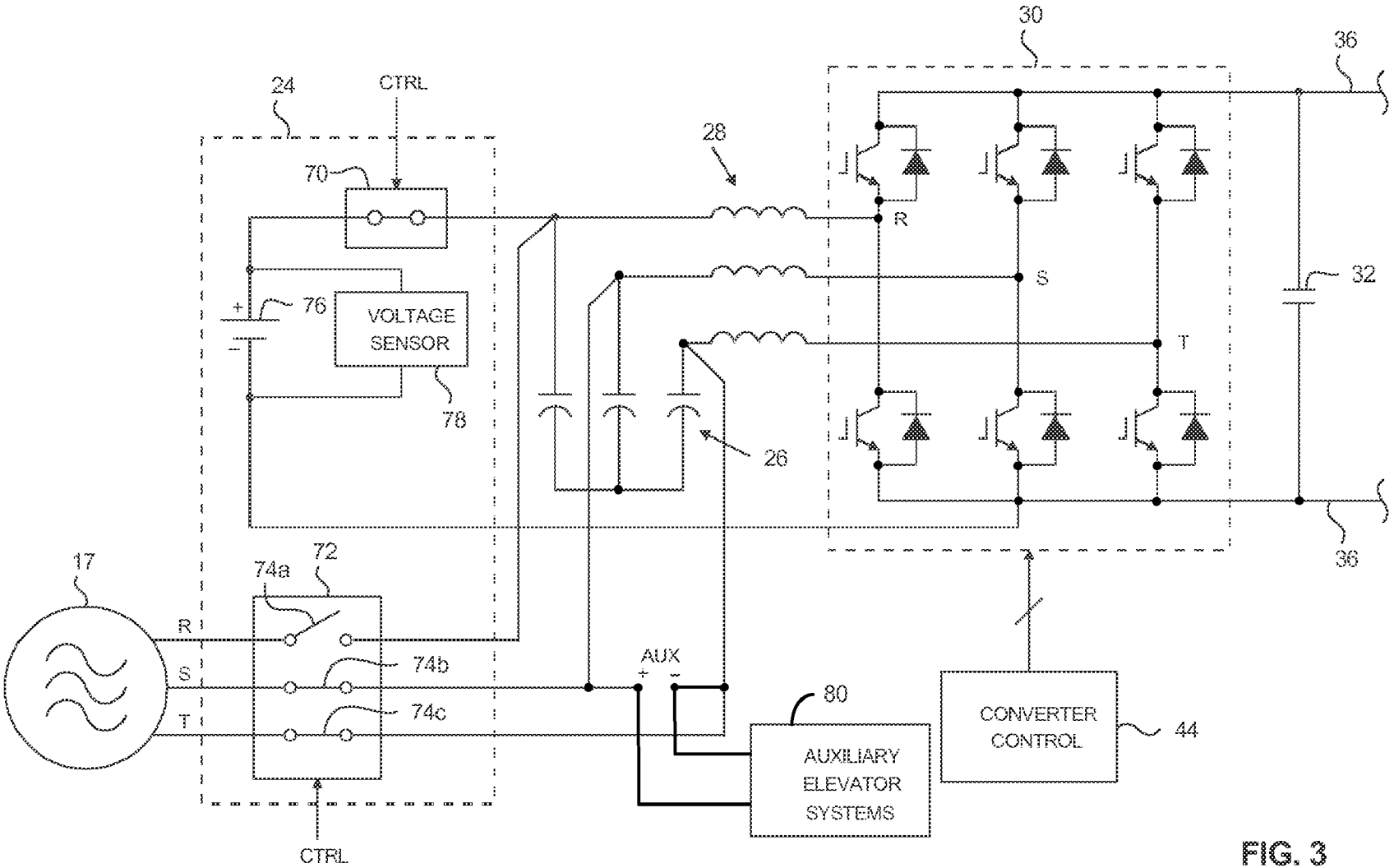
FIG. 3 is a schematic view of the automatic rescue operation circuit configured to provide power available on the regenerative drive to recharge the backup power supply.

FIG. 3 is a schematic view of the ARO circuit 24 configured to provide power available on power bus 36 to recharge battery 76. During periods of low use of elevator 16, power system 10 may be placed in power save mode by opening all three switches of main power switch module 72 and opening backup power switch 70 to cut power to elevator 16. At this time, voltage sensor 78 of ARO circuit 24 may measure the state of charge of battery 76. A signal is then sent to ARO control 40 related to the measured voltage of battery 76.

If the voltage across battery 76 is determined to be below a threshold voltage (as set in software), ARO control 40 operates ARO circuit 24 to provide power from main power supply 16 to recharge battery 76. In particular, phases S and T of main power supply 16 are connected to legs S and T of power converter 30 by closing main power switches 74*b* and 74*c*. Main power switch 74*a* remains open and backup power switch 70 is closed to connect battery 76 to leg R of power converter 30. Converter control 44 operates the transistors associated with legs S and T to convert the AC power from main power supply 16 to DC power. The converted DC power is provided on power bus 36. Converter control 44 operates the transistors associated with leg R of power converter 30 to provide a constant current from power bus 36 to battery 76 for recharging. In summary, the subject invention is directed to a system for continuously driving an elevator hoist motor during normal and power failure operating conditions. A regenerative drive delivers power to the hoist motor from a main power supply during the normal operating condition and from a backup power supply during the power failure operating condition. A controller operates the regenerative drive to provide available power on the regenerative drive to the backup power supply during the normal operating condition. In addition, the controller may provide signals to the regenerative drive to invert power from the backup power supply to drive auxiliary elevator systems during the power failure condition. Automatic rescue operation, powering of auxiliary systems, and charging of the backup power supply associated with automatic rescue operation are thus all achieved by controlling the regenerative drive to manipulate available power from the main and backup power supplies.

Although the present invention has been described with reference to examples and preferred embodiments, workers skilled in the art will recognize that changes may be made in form and detail without departing from the spirit and scope of the invention.

The invention claimed is:

1. A system for continuously driving an elevator hoist motor during normal and power failure operating conditions, the system comprising:

a regenerative drive operable to deliver power to the hoist motor from a main power supply during the normal operating condition and from a backup power supply during the power failure operating condition; and a controller for operating the regenerative drive to provide available power on the regenerative drive to the backup power supply during the normal operating condition;

wherein the regenerative drive comprises a converter connected to a power bus, the converter operable to convert alternating current (AC) power from the main power supply into direct current (DC) power deliverable to the power bus and to step-up DC power at a first voltage from the backup power supply to a second voltage deliverable to the power bus.

2. The system of claim 1, wherein the regenerative drive further comprises:

an inverter to drive the hoist motor by converting the DC power from the converter into AC power and, when the hoist motor is generating, to convert AC power produced by the hoist motor to DC power;

wherein the power bus is connected between the converter and the inverter to receive DC power from the converter and the inverter.

3. The system of claim 1, wherein the controller provides signals to the converter to deliver power on the power bus to the backup power supply.

4. The system of claim 3, wherein the converter is a three-phase converter that is controlled such that power from the main power supply is converted and delivered to the power bus on two phases and power on the power bus is delivered to charge the backup power supply on the third phase.

5. The system of claim 2, wherein the controller provides signals to the converter to invert DC power from the backup power supply to AC power for driving auxiliary elevator systems during the power failure condition.

6. The system of claim 5, wherein the converter comprises a plurality of power transistor circuits, each power transistor circuit comprising a transistor and a diode connected in parallel, and wherein the controller employs pulse width modulation to produce gating pulses to periodically switch the transistors to invert DC power from the backup power supply to AC power.

7. The system of claim 1, wherein the converter is a three-phase converter that is controlled such that power from the backup power supply is converted and delivered to the power bus on one phase and power on the power bus is delivered to drive auxiliary power systems on the other two phases.

8. The system of claim 1, wherein the regenerative drive is controlled to provide available power on the regenerative drive to the backup power supply if the backup power supply voltage is below a threshold voltage.

9. The system of claim 1, wherein the main power supply is connected to the regenerative drive to provide power to the backup power supply.

10. The system of claim 1, wherein the backup power supply comprises at least one battery.

11. The system of claim 1, wherein the controller disconnects the main power supply and the backup power supply from the regenerative drive during a power save condition.

12. A system for continuously driving an elevator hoist motor, the system comprising:

a converter operable to convert alternating current (AC) power from a main power supply into direct current (DC) power;

an inverter operable to drive the hoist motor by converting the DC power from the converter into AC power and, when the hoist motor is generating, to convert AC power produced by the hoist motor to DC power;

a power bus connected between the converter and the inverter to receive DC power from the converter and the inverter;

a rescue operation circuit including a backup power supply connected between the main power supply and the converter, wherein the rescue operation circuit is operable to disconnect the main power supply from the converter and connect the backup power supply to the converter in the event of a failure of the main power supply, and wherein the rescue operation circuit is further operable to connect the backup power supply to the main power supply through the converter to charge the backup power supply.

13. The system of claim 12, wherein the converter is a three-phase converter that is controlled such that power from the main power supply is converted and delivered to the power bus on two phases and power on the power bus is delivered to charge the backup power supply on the third phase.

14. The system of claim 12, wherein the converter is further operable to invert DC power from the power bus to AC power for driving auxiliary elevator systems.

15. The system of claim 14, wherein the converter is a three-phase converter that is controlled such that power from the backup power supply is converted and delivered to the power bus on one phase and power on the power bus is delivered to drive auxiliary power systems on the other two phases.

16. The system of claim 12, wherein the backup power supply is charged if the backup power supply voltage is below a threshold voltage.

17. The system of claim 12, wherein the backup power supply comprises at least one battery.

18. The system of claim 12, wherein the rescue operation circuit disconnects the main power supply and the backup power supply from the converter in power save mode.

19. A method for providing substantially uninterrupted power to an elevator hoist motor during normal and power failure conditions, the method comprising:

connecting a main power supply to a converter in a regenerative drive that drives the elevator hoist motor if the main power supply voltage is within a normal operating range;

disconnecting the main power supply from the converter in the regenerative drive and connecting a backup power supply to the converter in the regenerative drive if the main power supply voltage is below the normal operating range; and charging the backup power supply from the main power supply by connecting the main power supply and the backup power supply through the converter in the regenerative drive if the backup power supply voltage is below a threshold voltage.

20. The method of claim 19, wherein connecting the main power supply comprises closing main power switches connected between the main power supply and the regenerative drive and opening a backup power switch connected between the backup power supply and the regenerative drive.

21. The method of claim 19, wherein the disconnecting step comprises opening the main power switches and closing the backup power switch.

22. The method of claim 19, wherein the charging step comprises:

converting alternating current (AC) power from the main power supply to direct current (DC) power; and providing the DC power to the backup power supply.

23. The method of claim 19, and further comprising:

disconnecting the main power supply and the backup power supply from the regenerative drive in power save mode.

* * * * *